US006912735B2

(12) United States Patent
Sacree

(10) Patent No.: US 6,912,735 B2
(45) Date of Patent: Jul. 5, 2005

(54) HEAD PROTECTION APPARATUS

(75) Inventor: Jeffrey Arthur Sacree, Cornwall (GB)

(73) Assignee: Geck Head Gear Limited, Bude (GB)

( * ) Notice: Subject to any disclaimer, the term of this patent is extended or adjusted under 35 U.S.C. 154(b) by 0 days.

(21) Appl. No.: 10/487,079

(22) PCT Filed: Jun. 28, 2002

(86) PCT No.: PCT/GB02/03007

§ 371 (c)(1),
(2), (4) Date: Feb. 18, 2004

(87) PCT Pub. No.: WO03/001935

PCT Pub. Date: Jan. 9, 2003

(65) Prior Publication Data

US 2004/0205880 A1 Oct. 21, 2004

(30) Foreign Application Priority Data

Jun. 28, 2001 (GB) ..... 0115867

(51) Int. Cl.[7] ..... A42B 3/00
(52) U.S. Cl. ..... 2/413; 2/418; 2/419; 2/DIG. 3
(58) Field of Search ..... 2/414, 413, 411, 2/417, 418, 419, 412, 423, DIG. 3, DIG. 10

(56) References Cited

U.S. PATENT DOCUMENTS 2,706,294 A * 4/1955 Sprinkle ..... 2/414
3,221,340 A * 12/1965 Joffe
3,668,704 A * 6/1972 Conroy et al.
3,714,668 A * 2/1973 Mirabella ..... 2/419
3,761,959 A * 10/1973 Dunning
4,035,846 A * 7/1977 Jencks
4,075,717 A * 2/1978 Lemelson ..... 2/412
4,287,613 A * 9/1981 Schulz ..... 2/413
4,324,005 A * 4/1982 Willis ..... 2/413
4,566,137 A * 1/1986 Gooding
5,890,232 A * 4/1999 Park
5,913,412 A * 6/1999 Huber et al.
6,085,357 A * 7/2000 Broersma ..... 2/416

* cited by examiner

*Primary Examiner*—Rodney M. Lindsey
(74) *Attorney, Agent, or Firm*—Pearne & Gordon LLP

(57) ABSTRACT

An inflatable head-protection member comprises first and second ear-protective elements connected together by a web element, at least one of the ear-protective elements having extending therefrom substantially orthogonally to the web element a strap element having adjustable connection means to the other ear-protective element or to a corresponding strap element extending therefrom, the elements being air-inflatable and in mutual communication and having an inflation tube for insertion in the user's mouth and an inflation/deflation control means.

11 Claims, 1 Drawing Sheet

HEAD PROTECTION APPARATUS

This application claims the benefit of International Application Number PCT/GBO2/03007, which was published in English on Jan. 9, 2003.

This invention relates to head protection apparatus, particularly but not exclusively to helmets for recreational or emergency use, such as for example marine safety helmets for use by rescue personnel, coast guards and the like.

The object of the invention is primarily to enable a safety helmet of the type described to be easily size-adjusted so that a given helmet shell can fit different sized users' heads with comfort while still providing the required positional stability on the head. However, a subsidiary object is to provide a protective head-covering for light-duty use.

In connection with the primary objective it is proposed to provide a helmet shell with an inflatable liner. Such liners are however already known in principle, for example from U.S. Pat. No. 5,175,889, which describes a safety helmet having an inflatable liner positioned between the helmet shell and an inner liner cushion and extending in use from the back of the head around each side towards the temples of the user, above the ears, an inflation port being provided at the rear part of the liner.

According to one aspect of the present invention, an inflatable head-protection member comprises first and second ear-protective elements connected together by a web element, at least one of the ear-protective elements having extending therefrom substantially orthogonally to the web element a strap element having adjustable connection means to the other ear-protective element or to a corresponding strap element extending therefrom, the elements being air-inflatable and in mutual communication and having an inflation tube for insertion in the user's mouth and an inflation/deflation control means.

By "substantially orthogonally" is meant a relative disposition of the respective elements whereby, should the web element extend in use around the occipital region, the strap element or elements would extend around the upper anterior region of the skull, the respective elements thus subtending an angle of approximately 90° at each ear-protective element. The inflation/deflation control means comprises a control valve, preferably manually operable, for example of the type including a push-button or other depressible or squeezable element operative against a resilient bias to open the valve for inflation or deflation purposes.

The invention as described may be used as such and when inflated as a light-duty protective head covering although, preferably, one or more additional finger or link elements extend from median positions along the web element and have connection means, optionally removable or adjustable, to the strap element or elements to provide further protection to the top and upper posterior regions of the skull. However, the head-protection member preferably includes means for removable attachment within the rigid shell of a safety helmet, whereby the fit of the shell can be adjusted according to the extent of inflation. The inflated elements also provide a cushioning effect against impact forces. Preferably, the elements contain a resilient or pressure-deformable material such as an open-cell or foamed plastics material, possibly loosely packed, partly to enhance the cushioning effect, partly to maintain the shape and partly to reduce the internal volume of the inflatable elements to render them easier to inflate.

The or any additional finger or link elements may be detachable from the web element but preferably are integrally formed therewith and in inflatable communication therewith.

The respective elements of the head-protection member may comprise discrete chambers or pockets containing a resilient or pressure-deformable material, thereby preventing the material (if in particulate, for example spherical, form) from becoming unevenly distributed, the separate compartments or chambers being nevertheless in mutual inflatable communication.

The ear-protective elements preferably define a centrally-disposed aperture to avoid the ears being blocked or masked to incident noise. Conveniently, grommets can be used in conjunction with such apertures and corresponding apertures formed in the shell to locate and attach the liner to the shell at the position of the ear-protective elements.

The head-protection member is preferably formed from a vinyl plastics material having a fabric covering. The adjustable connection means may comprise tabs of hook-and-loop fastener material which can be passed through ring or slot members and self-secured. The inflation tube is preferably attached to the web element in proximity to one of the ear-protective elements, in order to be conveniently disposed for insertion in the mouth.

Embodiments of the invention will now be described by way of example with reference to the accompanying drawings, of which FIG. 1 is a plan view of a head protector according to the invention;

Figure 1:
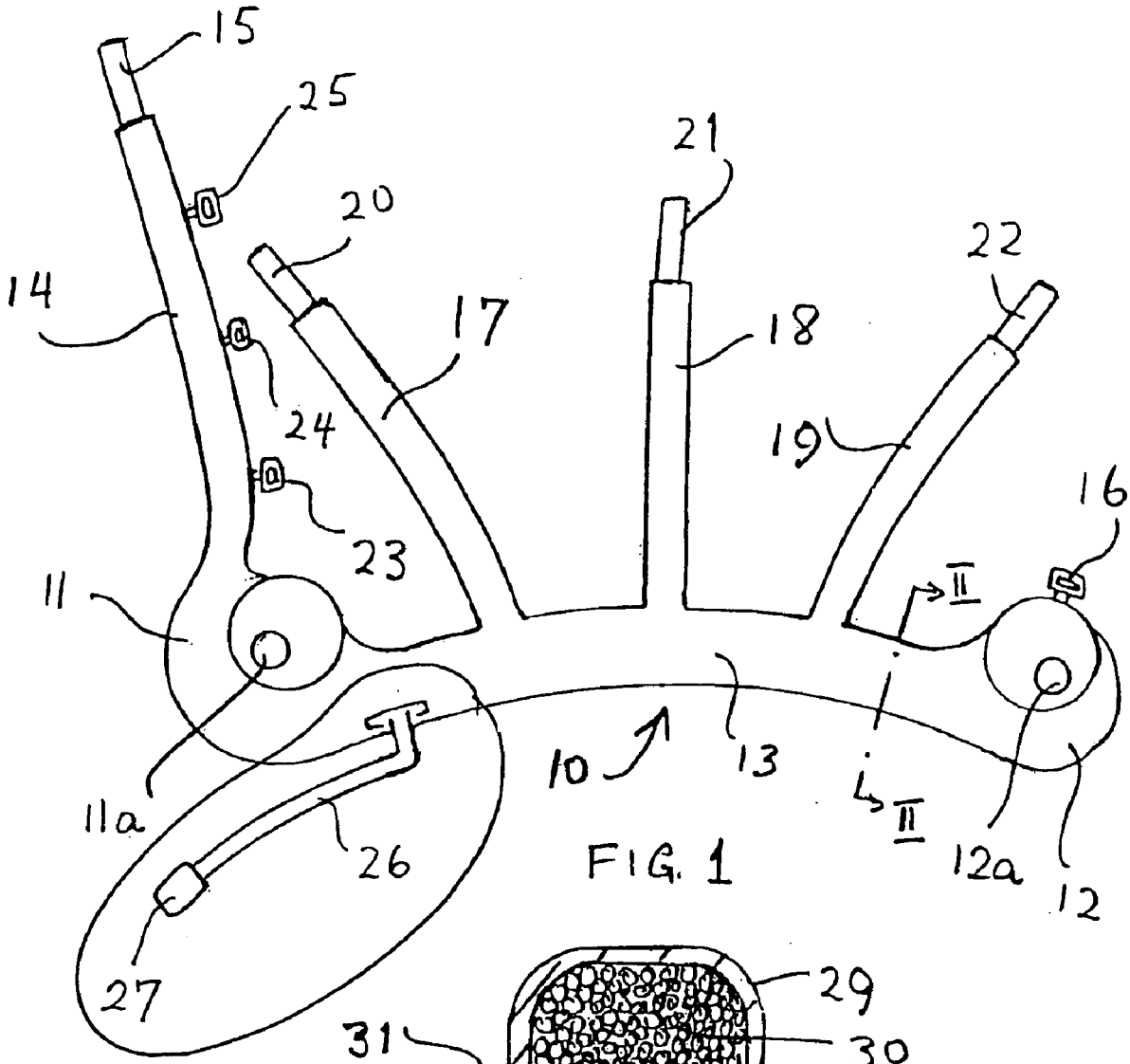

Referring firstly to FIG. 1, the head protector, shown generally at 10, has earpieces 11, 12 each formed with a respective aperture 11*a*, 12*a* and connected together by a web element 13. Earpiece 11 has a strap member 14 extending therefrom at approximately 90° to web element 13, the strap 14 terminating in a strip of "Velcro" hook-and-loop fastener material 15. The other earpiece 12 has fastened thereto a clasp 16 or buckle for engaging in use with the fastener material 15. Extending from the web element 13 are finger members 17, 18, 19 each terminating in respective strips of "Velcro" fastening material 20, 21, 22 for attachment to corresponding clasp or buckle elements 23, 24, 25 attached to the member 14. The various parts 13 to 15 and 17 to 19 are in inflatable communication with each other and, for the purpose of inflation and deflation, an inflation tube 26 is attached to the web element 13 in proximity to earpiece 11 and has a mouth piece 27 at the distal end thereof. The inflation tube is provided with a manually-operable valve element (not shown) which can be opened to allow inflation or deflation, as required, to take place.

Figure 2:
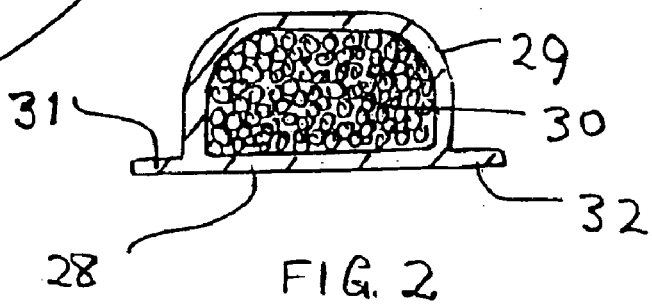
FIG. 2 is a cross-section along the line II—II of FIG. 1.

Referring now to FIG. 2, which is a cross-section through the web element 13, it is seen that the element consists of a base 28 and a cover 29 forming a sealed tube which contains a foamed plastics material 30 such as an open-celled foam formed from a polyurethane. The base 28 extends on either side of the cover to form respective side flanges 31, 32. The tube is formed from a vinyl plastics material and is covered with a fabric material for comfort and to improve the appearance.

Figure 3:
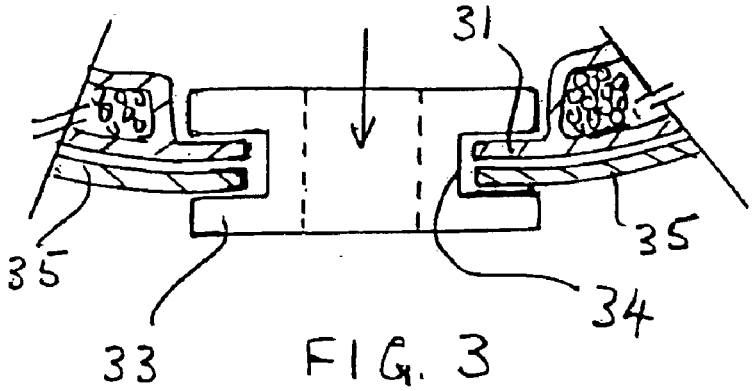
FIG. 3 is a cross-section showing the use of a grommet for attaching the head protector to a helmet shell.

Referring to FIG. 3, a rubber or other resilient plastics grommet 33 has a peripheral groove 34 which receives an ear piece aperture formed in the rigid helmet shell 35 and also the annular edge defining one of the apertures 11*a*, 12*a*, formed in the ear pieces. As illustrated, the flange 31 is shown engaged with the shell 35 in the groove 34, thereby maintaining the liner and shell in correct registration for the ears when the helmet is in use.

In order to prepare the apparatus for use, the fastening materials 15 and 20 to 22 are initially engaged in their respective clasps, the fastening material providing for adjustment of size according to the size of the user's head or of the helmet shell. If the apparatus is to be fitted within a helmet shell, it may be secured therein by further strips of "Velcro" fastening material, not shown. The inflatable elements are then inflated via the inflation tube to provide a comfortable fit and, when it is desired to remove the helmet from the head, the apparatus may be deflated to allow easy removal. The apparatus provides resilient cushioning for the sides of the head around the ears, around the occipital region and around the upper anterior region of the skull and renders a one-size shell comfortable for use irrespective of the size of the user's head.

What is claimed is:

1. An inflatable head-protection member comprising first and second ear-protective elements connected together by a web element, at least one of the ear-protective elements having extending therefrom substantially orthogonally to the web element a strap element having adjustable connection means to the other ear-protective element or to a corresponding strap element extending therefrom, the elements being air-inflatable and in mutual communication and having an inflation tube for insertion in the user's mouth and an inflation/deflation control means.

2. A member according to claim 1, in which the inflation/deflation control means comprises a manually-operable control valve.

3. A member according to claim 1 or claim 2, in which the member includes one or more additional finger or link elements extending from median positions along the web element and having connection means to the strap element or elements.

4. A member according to claim 3, in which the additional elements are removable or adjustable with respect to the strap element or elements.

5. A member according to claim 1, further including means for removable attachment within the rigid shell of a safety helmet.

6. A member according to claim 1, in which the elements contain a resilient or pressure-deformable material.

7. A member according to claim 3, in which the additional finger or link elements are integrally formed with the web element and are in inflatable communication therewith.

8. A member according to claim 1, in which at least the respective elements comprise discrete chambers or pockets containing a resilient or pressure-deformable material.

9. A member according to claim 1, in which the ear-protective elements define a centrally-disposed aperture.

10. A helmet for recreational or emergency use and comprising an outer shell having a liner comprising an inflatable head-protection member according to claim 1.

11. A helmet according to claim 10 including grommets to hold the shell and liner in registration at the position of the ear-protective elements.

* * * * *

UNITED STATES PATENT AND TRADEMARK OFFICE

CERTIFICATE OF CORRECTION

PATENT NO. : 6,912,735 B2
DATED : July 5, 2005
INVENTOR(S) : Sacree

It is certified that error appears in the above-identified patent and that said Letters Patent is hereby corrected as shown below:

Title page,
Item [73], Assignee, please delete "Geck Head Gear Limited, Buse (GB)" and insert therefor -- Gecko Head Gear Limited, Cornwall (GB) --.

Signed and Sealed this

Sixth Day of December, 2005

JON W. DUDAS
*Director of the United States Patent and Trademark Office*